US005339976A

United States Patent [19]

Thornton

[11] Patent Number: 5,339,976

[45] Date of Patent: Aug. 23, 1994

[54] MATING SEPARABLE CONTAINERS

[76] Inventor: Danny M. Thornton, 7509 Clyde Rd., Chattanooga, Tenn. 37421

[21] Appl. No.: 155,555

[22] Filed: Nov. 22, 1993

[51] Int. Cl.[5] ..... B65D 21/02

[52] U.S. Cl. ..... 220/23.4; 220/342; 220/735

[58] Field of Search ..... 220/23.4, 342, 343, 220/735

[56] References Cited

U.S. PATENT DOCUMENTS

| | | | |
|---|---|---|---|
| D. 212,109 | 8/1968 | Taylor . | |
| D. 221,883 | 9/1971 | Cash . | |
| D. 339,030 | 9/1993 | Bitel, Sr. . | |
| 2,331,216 | 10/1943 | Mitchell | 220/343 |
| 2,495,132 | 1/1950 | Remco . | |
| 2,575,294 | 11/1951 | Putorak . | |
| 2,740,632 | 4/1956 | Balmer | 220/343 |
| 3,007,595 | 11/1961 | Remley | 220/343 |
| 3,398,827 | 8/1968 | Laskin . | |
| 3,404,818 | 10/1968 | Miscoe | 220/23.4 |
| 3,501,044 | 3/1970 | Stone . | |
| 3,815,281 | 6/1974 | Kander | 220/23.4 |
| 4,871,083 | 10/1989 | DiNardo | 220/23.4 |
| 4,966,296 | 10/1990 | Farrell . | |
| 5,211,302 | 5/1993 | Tiramani | 220/342 |

*Primary Examiner*—Joseph Man-Fu Moy
*Attorney, Agent, or Firm*—Richard C. Litman

[57] ABSTRACT

A plurality of mating separable containers includes cooperating lugs or ears between containers, providing for the removable insertion of a pin (e.g., the handle of an eating utensil, such as a fork, knife, spoon, chopstick, etc.) therethrough to secure the containers together. At least one of the containers includes an arcuately curved resilient wall from which the ear(s) extend(s), thus purposely misaligning the passages through the ears or lugs of the adjoining containers. The resilience of the wall allows the passages to be biased into alignment for the insertion of a utensil handle therethrough, and serves to retain the utensil handle therein to preclude accidental loss and separation of the containers. Placing the attachments on the sides of the containers, rather than along the upper edges, allows lids to be removably installed along the upper edges, as in non-connectable containers. The containers may be made in any suitable size and shape, and are preferably formed of a material (e.g., plastic) which is suitable for heating in a microwave oven. The containers may be made of a durable material for reuse, or alternatively may be made of a disposable material for single usage. The containers provide for the selectable heating or cooling of foods or other articles therein, by removing the utensil(s) or pin(s) between containers and heating or cooling only those containers desired.

13 Claims, 3 Drawing Sheets

MATING SEPARABLE CONTAINERS

FIELD OF THE INVENTION

The present invention relates generally to containers for the storage of food or other articles, and more specifically to plural containers which may be connected by means of interlinked lugs or ears extending therefrom. The containers are preferably flexible and formed to misalign the lugs intentionally in order to bias a removable pin (e.g., utensil handle ) therein to retain the pin.

BACKGROUND OF THE INVENTION

The microwave oven has proven increasingly popular in virtually every kitchen, from restaurants to private homes and even to the kitchen areas of most workplaces. Many employees prefer to bring their lunch from home in order to keep to a special diet, save money, enjoy particularly favorite foods not otherwise readily available, etc., and the microwave oven has enabled such employees to have a hot lunch with a minimum of time and preparation of the food. Even in the home, the microwave has made it possible to heat or cook food or warm leftovers in a minimum amount of time.

Containers having separate sections, but being monolithically formed as a single unit, are well known for such uses to provide for the separation of different types of foods (e.g., entrees, salads, desserts, etc.), but a problem arises when foods requiring different temperatures in order to be palatable, are stored in such containers. As the entire container must be placed in the oven, all of the foods therein are heated approximately to the same extent, resulting in foods normally eaten at room temperature or chilled, being heated so they are no longer palatable.

Numerous mating separable containers have been developed in the past in order to overcome this or other problems, but none are known which also provide for the storage of the utensils (fork, knife, spoon) which are needed to eat the meal contained within the containers. These utensils must be carried separately, and in fact in some instances persons will store the utensils within an otherwise empty container for use with the meal. This is particularly hazardous with microwave heated foods, as metal utensils which are inadvertently left in a container are prone to absorbing a great deal of microwave energy and becoming extremely hot, possibly melting the container in which they are stored and/or damaging, the microwave oven due to reflected energy.

The need arises for mating, separable containers capable of containing the various food items which might normally be desired by a person for a meal. The containers must provide for ease of separation in order to allow the heating of only those foods desired, with other foods being separated in their separable containers, from those being heated. The containers must also provide a means for the carriage and storage of the eating utensils required, which storage and carriage means also provides the mutual attachment means for the joined containers. The utensils must be removed from the containers when they are separated for the placement of one or more of the containers in the microwave oven, thus precluding their inadvertent placement in the oven and any possible subsequent damage. Finally, the containers must provide means for securing the utensils in place to preclude inadvertent separation of the utensils from the containers, and thus to preclude inadvertent separation of the containers from one another, until desired.

DESCRIPTION OF THE PRIOR ART

U.S. Pat. No. 2,495,132 issued to John L. Remco on Jan. 17, 1950 discloses a Sectional Plate including cooperating mating edges which are slid together to join the different sections. No means is provided for the biasing of the joined sections together to prevent their inadvertent separation, nor for the storage of eating utensils therewith, particularly by using such utensils as a component(s) of the assembly. In addition, no means is seen for the installation of separate lids upon each of the sections, as the joint means along the edges of the sections preclude the installation of the lip of a lid thereover, particularly when the sections are assembled together.

U.S. Pat. No. 2,575,294 issued to Walter B. Putorak on Nov. 13, 1951 discloses a Sectional Baking Pan comprising a plurality of individual sections, each having cooperating interlocking edges. While means are provided to prevent the inadvertent separation of the assembled sections, no means is provided for the storage of additional utensils, nor for the use of such utensils in the assembly of the sections, as in the present invention. Moreover, no lid(s) is/are disclosed for the pan(s).

U.S. Pat. No. 3,398,827 issued to Maurie Laskin on Aug. 27, 1968 discloses Trays And Multi-Tray Packages. One embodiment discloses a plurality of cooperating trays, but these, trays must be assembled by placing them in a larger tray to contain them; no interlocking means is disclosed between the individual trays. Also, no lid or cover is disclosed.

U.S. Pat. No. 3,501,044 issued to Stanford C. Stone on Mar. 17, 1970 discloses a Disposable Tray With Removable Inserts. A frame is provided with resilient tabs to lock separate containers therein. Again, no storage means for utensils, or lids or other covering is disclosed.

U.S. Pat. No. 4,966,296 issued to Leslie A. Farrell on Oct. 30, 1990 discloses an Integrated Food Tray With Individual Separable Food Containers For Heating And Cooling Food. The containers either include separation lines (perforations) providing for their one time separation, or are contained in a surrounding housing, from which they are removed for selective heating. Covers are disclosed over each of the individual containers, but they are one time use covers. In fact, the entire apparatus lends itself particularly to discarding after use, rather than being reusable as in at least one embodiment of the present invention. Moreover, no means for the inclusive retention of eating utensils is disclosed, as provided for by the present invention.

U.S. Pat. Des. No. 212,109 issued to William D. Taylor on Aug. 27, 1968 discloses a Rotatable Canister Unit having a plurality of containers resting upon an underlying tray. The individual containers are not interlocked, but are retained by the edge of the underlying tray. It appears that lids are provided which extend at least slightly beyond the upper edges of the individual containers, as the containers have no interlocking edges to preclude the installation of lids thereon. No utensil storage is disclosed.

U.S. Pat. Des. No. 221,883 issued to John B. Cash on Sep. 14, 1971 discloses a Buffet Tray formed as a single, monolithic unit with inseparable trays therein.

Finally, U.S. Pat. Des. No. 339,030 issued to Vincent J. Bitel, St. on Sep. 7, 1993 discloses a Stacking Dish similar to the Cash tray discussed above.

None of the above noted patents, taken either singly or in combination, are seen to disclose the specific arrangement of concepts disclosed by the present invention.

SUMMARY OF THE INVENTION

By the present invention, improved mating separable containers are disclosed.

Accordingly, one of the objects of the present invention is to provide improved mating separable containers which provide for the separable joining together of at least two containers by means of a common removable pin therebetween.

Another of the objects of the present invention is to provide improved mating separable containers in which such pin comprises the handle of an eating utensil, such as a fork, knife, or spoon.

Yet another of the objects of the present invention is to provide improved mating separable containers which include at least one curvilinear mating side, which curved side serves to misalign the mating means in order to bias a pin inserted therein to preclude its inadvertent loss and subsequent accidental separation of the containers.

Still another of the objects of the present invention is to provide improved mating separable containers which may include removable lids therefor.

A further object of the present invention is to provide an improved mating separable containers which are formed of a material compatible for heating in microwave ovens.

An additional object of the present invention is to provide improved mating separable containers which may be formed of a durable and reusable material, or which may alternately be formed of a relatively inexpensive material providing for disposal after a single use.

Another object of the present invention is to provide improved mating separable containers which may be formed in a variety of shapes and sizes, as suitable for the specific use desired.

Yet another object of the present invention is to provide improved mating separable containers which may comprise two, three or more containers separably joinable along a common one, two or more connecting sides.

Still another object of the present invention is to provide improved mating separable containers which include means precluding relative axial rotation of the containers along their common joints when assembled together.

A final object of the present invention is to provide improved mating separable containers for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
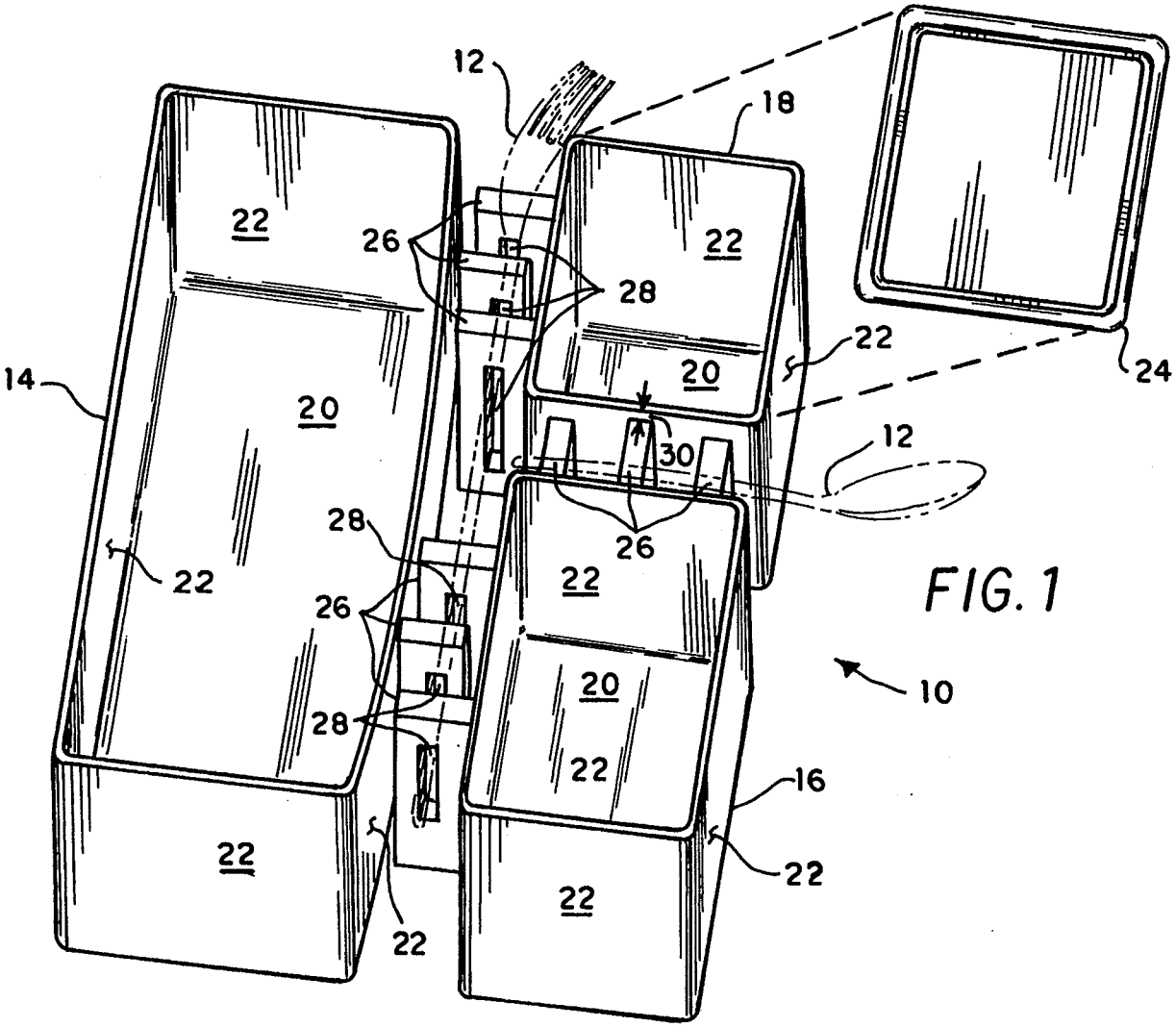
FIG. 1 is a perspective view of the containers of one embodiment of the present invention, showing the means for joining them together and also showing a removable lid for at least one container.

Referring now particularly to FIG. 1 of the drawings, the present invention will be seen to relate to a plurality of mating separable containers 10, each of which is removably joinable to the other(s) by means of a rigid attachment pin 12, which pin 12 may comprise the handle of an eating utensil, such as a fork, knife, spoon, chopstick, or other relatively thin and elongate article. The assembly 10 of FIG. 1 includes first, second and third separable containers 14, 16 and 18 each of which include a bottom surface 20 and side walls 22. One or more lids 24 may be provided in order to close and seal the interior(s) of the container(s) 12, 14, and/or 16, as desired.

At least one wall 22 of each of the joinable containers 10, 12 and 14 includes at least one attachment ear, lug or boss 26 extending outwardly therefrom, with each of the attachment ears 26 having an attachment pin passage 28 therethrough and substantially parallel to the wall 22 from which the respective attachment ear 26 extends. While the attachment pin passages 28 may be of any suitable cross sectional shape, preferably passages 28 are formed in a rectangular cross section, being relatively wide in one direction and relatively narrow or thin in the perpendicular direction. Such a passage shape conforms nicely to the typical eating utensil or "flatware" handle 12, although other shapes may be used for the passages 28 as well as the attachment pin(s) 12. By providing a passage 28 shape which closely conforms to any non-circular cross sectional shape of the attachment pin 12 being used, axial rotation of the pin 12 is precluded within the passages 28, and thus any substantial relative arcuate movement of the containers 14 through 18 about a mutual pin 12, is also precluded. Thus, a user may grasp a single container 14 through 18 without fear that any of the other attached containers will tip and cause any contents therein to spill. It will be further noted that the attachment ears 26 do not extend completely to the upper edge of their respective walls 22, but that there is a space 30 (shown on container 20) between the upper edge of the wall 22 and the top of the ears 26. This provides space for the attachment lip of any lid 24 to be sealed to the underlying edge of the container, thereby further precluding any spillage of contents.

In the example of FIG. 1, each of the smaller containers 16 and 18 includes two spaced apart attachment ears or lugs 26, while the facing wall of the larger container 14 includes a single ear 26 between each of the ears 26 of the other containers 16 and 18. In a like manner, one of the other containers (e.g., 16) includes two spaced apart ears 26 extending from a wall 22, while the facing wall 22 of the opposite container (e.g., 18) includes only a single ear 26 extending therefrom and between the two ears 26 of the opposite container. Thus, each of the two facing walls 22 of each adjacent container 14, 16 and 18, will have a total of at least three alternating lugs or ears 26 and attachment pin passages 28 therebetween, to define an axis through the alternating passages 28. This is shown more clearly in FIG. 3, described below.

Figure 3:
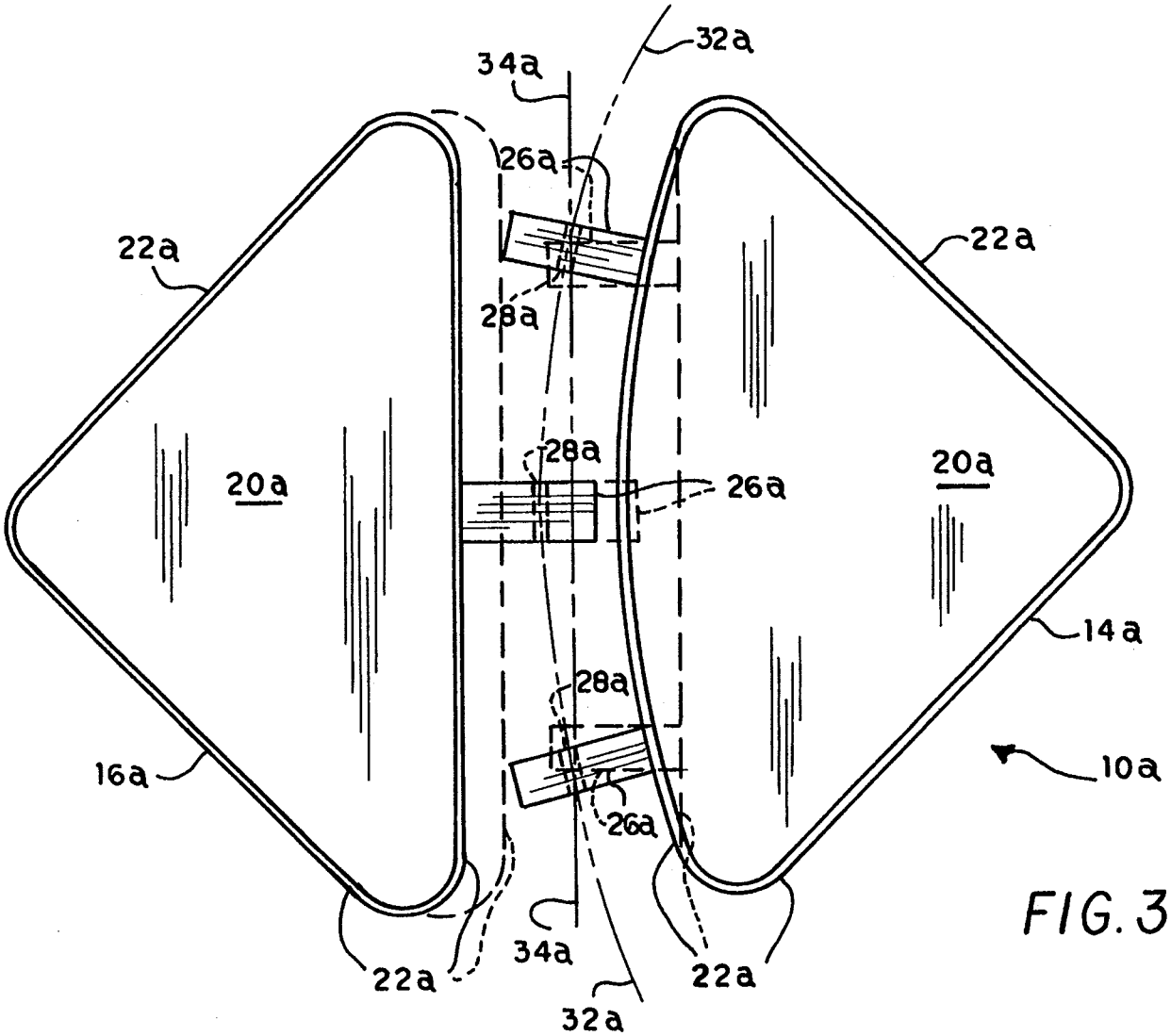
FIG. 3 is a top plan view of a third embodiment, showing the positions of the container joining means in both the relaxed, unassembled state and the assembled state.

FIG. 3 discloses an assembly of containers 10*a* in which each container 14*a* and 16*a* is removably joinable to the other(s) by means of a rigid attachment pin (not shown), as in FIG. 1. Each of the containers 14*a* and 16*a* are preferably formed generally as the containers 14 through 18 of FIG. 1, including bottom surfaces 20*a* and plural side walls 22*a*. At least one side wall 22*a* of each container 14*a* and 16*a* includes at least one attachment lug or ear 26*a* extending outwardly therefrom, as in the containers 14 through 18 of FIG. 1. In the example of FIG. 3, container 14*a* will be seen to include two spaced apart lugs or ears 26*a* disposed along the wall 22*a* facing the opposite container 16*a*, while container 16*a* includes a single ear 26*a* facing container 14*a*. Thus, the container assembly 10*a* of FIG. 3 includes at least three alternatingly opposed lugs 26*a* (each of which include an attachment pin passage 28*a*), just as in the case of each of the facing sides or walls 22 of the container assembly 10 of FIG. 1.

However, containers 14*a* and 16*a* are shown in their unassembled state in FIG. 3 wherein the curvilinear form of the attachment lug wall 22*a* of container 14*a* in its relaxed state, is clearly visible. (This curve of the attachment lug side wall 22*a* of container 14*a* has been somewhat exaggerated for clarity.) It will be seen that the curve of the attachment ear side wall 22*a* of container 14*a*, in combination with the opposing attachment ear 26*a* therebetween extending from the opposite container 16*a*, will result in an arcuate alignment (and therefore linear misalignment) of the attachment pin passages 28*a* within the attachment lugs 26*a*; this arcuate alignment is indicated by the arcuate centerline 32*a* of FIG. 3.

In order to assemble the two containers 14*a* and 16*a* together, the two opposed attachment lug side walls 22*a* of the two containers must be pushed together, whereupon the centermost attachment lug 26*a* will cause the resilient material of the opposed attachment lug side wall to flex to a straighter alignments, indicated by the straight centerline 34*a*. At this point, a rigid attachment pin (not shown in FIG. 3 for clarity; see FIGS. 1 and 2) may be inserted through the three attachment pin passages 28*a*, thereby securing the two containers 14*a* and 16*a* together. The curvilinear nature of the at least one side wall (e.g., side wall 22*a* of container 14*a* in FIG. 3) causes the attachment ears 26*a* and passages 28*a* to tend toward misalignment again, which tendency is resisted by the rigid attachment pin inserted therein. The lateral force on the pin caused by the misalignment tendency of the attachment ears 26 and passages 28, serves to capture and hold the alignment pin therein, precluding its slippage or inadvertant removal from the attachment pin passages 28*a*.

When separation of the two containers 14*a* and 16*a* is desired, moderate tensile force on the pin or utensil securing the containers together is sufficient to withdraw the pin, particularly when the two opposed walls 22*a* having the attachment ears 26 extending therefrom are urged together. Yet, the biasing force is sufficient to preclude the accidental slippage of the pin from the attachment pin passages 28*a*. It will be seen that the above principle of operation is applicable to each of the opposed sets of attachment ears 26 shown in FIG. 1, also. The present invention provides for the securing together of any practicable number of mating containers of any practicable shape and configuration, so long as each of the containers includes alternating attachment lugs or ears on opposed side walls of two or more adjacent containers, and so long as the attachment pin passages therein are naturally misaligned in order to capture securely an attachment pin when such is installed therein.

Figure 2:
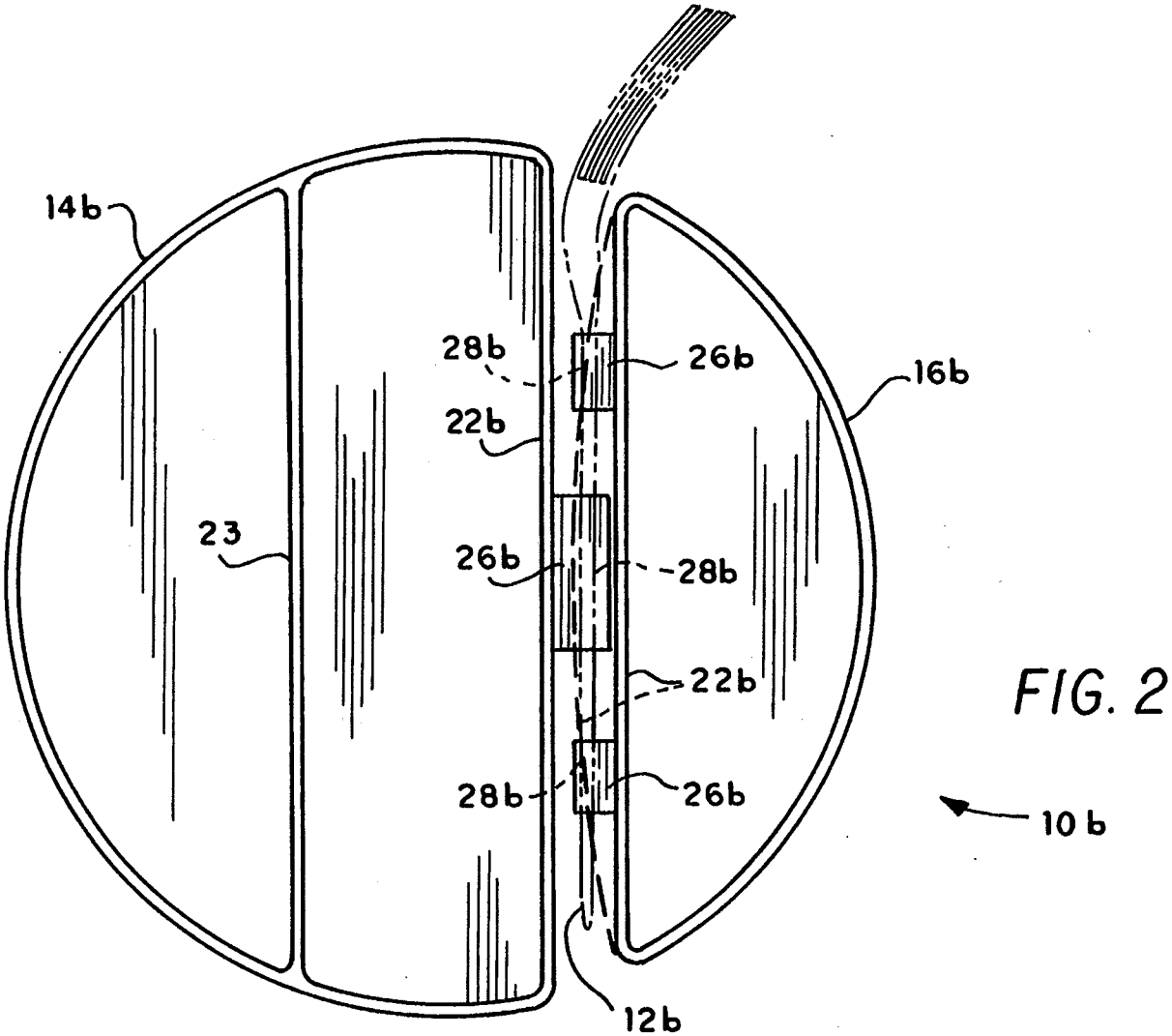
FIG. 2 is a top plan view of a second embodiment of the present invention, showing further details of the means provided for biasing a pin or utensil handle in place.

FIG. 2 discloses yet another embodiment of the present invention, in which a container assembly 10*b* comprises two semicircular containers 14*b* and 16*b*, each removably attachable from the other by means of an attachment pin 12*b* such as the handle of an eating utensil (fork) shown. The principle of operation of the container assembly 10*b* of FIG. 2 is identical to that of the container assemblies 10 and 10*a* respectively of FIGS. 1 and 3. However, it will be seen that the container assembly 10*b* of FIG. 2 forms a substantially circular assembly when the two containers 14*b* and 16*b* are joined together, rather than the rectangular assemblies 10 and 10*a* of FIGS. 1 and 3. Again, virtually any shapes and configurations may be used, so long as each of the adjacent containers has cooperating side walls and attachment ears.

In the case of containers 14*b* and 16*b* of FIG. 2, it will be seen that at least one side wall 22*b* of each container faces the opposite mating container and includes at least one attachment lug or ear 26*b* extending outwardly therefrom. In this case, container 16*b* includes two spaced apart attachment ears 26*b*, while the opposite mating container 14*b* includes a single attachment ear disposed therebetween when assembled, to provide the attachment pin path provided by attachment pin passages 28*b*, required for assembly. The assembly of the two separate containers 14*b* and 16*b* is performed in the same manner as with container assemblies 10 and 10*a* of FIGS. 1 and 3, by flexing at least one of the facing walls 22*b* (the wall 22*b* of container 16*b* is shown in its natural curvilinear state by the broken line in FIG. 2) to straighten the path formed by the attachment ear passages 28*b*, and inserting a rigid attachment pin 12*b* (e.g., fork) therethrough. While the assembly principle of each of the embodiments of FIGS. 1, 2, and 3 remains the same, it will again be seen that the containers comprising each assembly 10, 10*a* and/or 10*b* may have a variety of configurations. e.g., the plurally compartmented container 14*b* of FIG. 2, in which the container 14*b* is divided by a secondary wall 23. Any of the other containers discussed above may be similarly configured, if desired. It will be further noted that, while the present specification discloses plural mating containers in a substantially coplanar array, that the attachment ears or lugs may also be configured and disposed upon the containers to permit an overlying and underlying relationship between containers, using the same principle of interconnection described above.

The present invention may be used to store and contain any number of articles or substances, but is primarily directed to the storage of foods, particularly for midday meals. Various different foods having different preparation or heating requirements (e.g., frozen dessert, salad, and hot entree) may be placed in the plural containers of the present invention, and the various containers assembled using various eating utensils, as described above. When the meal is to be prepared, the containers may be separated by withdrawing the utensils used to secure the containers together, and the container(s) having contents requiring heating may be heated separately from those containers having food to be served at room or colder temperatures.

While the present invention is not limited to a specific type of preparation, it is particularly adaptable to use with microwave ovens. The containers of the present invention may be formed of any number of suitable materials, e.g., metal for use in standard ovens, but are preferably formed of materials suitable for use in microwave ovens (e.g., plastics). Due to the need to separate the containers in order to place only those requiring heating in an oven, the pins or utensils used to secure the containers together will be removed therefrom in any case, precluding heating of the utensils themselves. While the containers of the present invention may be formed of a durable material permitting reuse, it will also be noted that the present invention also lends itself to disposable containers formed of a suitable inexpensive and disposable material (e.g., a liquid resistant coated paper material or the like). In such case, the containers may be separated by removing the utensil pin as described above, and after preparing and consuming the food, the containers may simply be discarded rather than saved for reuse.

In accordance with the above disclosure, the present invention will be seen to provide a convenient means to retain all of the related elements of a single meal physically together. The convenience of the invention lends itself particularly to midday meals while in the workplace, and even more particularly to use with microwave ovens when the present containers are formed to be compatible with such. The user of the present invention need not ever have to contend with foods heated or prepared universally, and thus destroying the palatability of some of the courses. Yet, the mating containers of the present invention preclude inadvertent misplacement of one or more separate courses, or the utensils required for consumption of the meal, due to the particular arrangement discussed above. The present invention will be seen to provide convenience, as well as means for a satisfactory and palatable meal, to the user thereof.

It is to be understood that the present invention is not limited to the sole embodiments described above, but encompasses any and all embodiments within the scope of the following claims.

I claim:

1. Mating separable containers, comprising:

a plurality of cooperating containers, each including at least a bottom surface and a plurality of side walls;

at least one of said side walls of at least one of said cooperating containers including at least one attachment ear extending therefrom and at least one of said side walls of at least one other of said cooperating containers including at least two attachment ears extending therefrom, with said at least one attachment ear of said at least one of said cooperating containers being positioned between said at least two attachment ears of said at least one other of said cooperating containers when said cooperating containers are assembled together;

said attachment ears each including an attachment pin passage therethrough, with each said attachment pin passage including an attachment pin axis therethrough, and;

at least one rigid attachment pin removably insertable through said attachment pin passage of at least one attachment ear of said at least one of said cooperating containers and each said attachment pin passage of said at least two attachment ears of said at least one other of said cooperating containers, said attachment pin comprises a handle of an eating utensil, whereby;

said cooperating containers are joinable by aligning said attachment pin passages of said at least one attachment ear of said at least one of said cooperating containers and said at least two attachment ears of said at least one other of said cooperating containers and inserting said attachment pin therethrough, with said cooperating containers being separable by removing said attachment pin.

2. The mating separable containers of claim 1 wherein:

said at least one of said side walls of at least one of said cooperating containers including at least one attachment ear extending therefrom is formed of a resilient material having an arcuate curve therealong to misalign purposely said attachment pin passages from a linear alignment when said at least one of said cooperating containers and said at least one other of said cooperating containers are joined, whereby;

said wall formed of resilient material is resiliently flexed to align said attachment pin passage of said at least one attachment ear thereon with said attachment pin passages of said attachment ears of said at least one other of said cooperating containers, and said attachment pin is inserted through said attachment pin passages and biased therein by said wall formed of resilient material urging the misalignment of said attachment pin passages against said attachment pin.

3. The mating separable containers of claim 1 wherein:

said containers are formed of a durable and reusable material.

4. The mating separable containers of claim 1 wherein:

said eating utensil handle comprises a substantially flat and wide cross section, and each of said attachment pin passages comprises a substantially flat and wide opening to be substantially congruent with said eating utensil handle cross section, whereby;

axial rotation of each of said attachment ears about said handle of said eating utensil, and axial rotation of said containers relative to one another, is precluded.

5. The mating separable containers of claim 1 wherein:

at least one of said containers includes a removably installable lid thereon.

6. The mating separable containers of claim 1 wherein:

said mating separable containers comprise two said containers and one said attachment pin axis.

7. The mating separable containers of claim 1 wherein:

said mating separable containers comprise three said containers and two said attachment pin axes.

8. The mating separable containers of claim 1 wherein:

said containers comprise a substantially round planform when assembled.

9. The mating separable containers of claim 1 wherein:

said containers comprise a substantially rectangular planform when assembled.

10. The mating separable containers of claim 1 wherein:

said containers form a substantially coplanar array when assembled.

11. The mating separable containers of claim 1 wherein:

said containers are formed of a resilient plastic material capable of being heated in a microwave oven without damage.

12. The mating separable containers of claim 1 wherein:

said containers are formed of a liquid resistant coated paper material, whereby;

said containers are economically disposable.

13. The mating separable containers of claim 12 wherein:

said containers are formed of a material capable of being heated in a microwave oven without damage.

* * * * *